US005446976A

United States Patent [19]

Donnadieu et al.

[11] Patent Number: 5,446,976

[45] Date of Patent: Sep. 5, 1995

[54] BOOT FOR PERFORMING A GLIDING SPORT WITH AN ELASTIC DEVICE FOR BIASING THE COLLAR

[75] Inventors: Thierry Donnadieu; Frédéric Cretinon, both of Poisy, France

[73] Assignee: Salomon S.A., Metz-Tessy, France

[21] Appl. No.: 140,417

[22] Filed: Oct. 25, 1993

[30] Foreign Application Priority Data

Nov. 6, 1992 [FR] France ..... 9213566

[51] Int. Cl.[6] ..... A43B 5/04

[52] U.S. Cl. ..... 36/117; 36/121

[58] Field of Search ..... 36/117–121, 36/109, 115, 88, 89, 50.5

[56] References Cited

U.S. PATENT DOCUMENTS

| | | | |
|---|---|---|---|
| 3,619,914 | 11/1971 | Hanson et al. | 36/121 |
| 4,085,528 | 4/1978 | Delery | 36/121 |
| 4,694,593 | 9/1987 | Petrini et al. | 36/120 |
| 4,712,315 | 12/1987 | Morell et al. | 36/117 |
| 4,777,742 | 10/1988 | Petrini et al. | 36/121 X |
| 5,177,884 | 1/1993 | Rullier et al. | 36/117 |

FOREIGN PATENT DOCUMENTS

| | | | |
|---|---|---|---|
| 0050607 | 4/1982 | European Pat. Off. | 36/120 |
| 0416437 | 3/1991 | European Pat. Off. | A43B 5/04 |
| 0514642 | 11/1992 | European Pat. Off. | A43B 5/04 |
| 2330345 | 6/1977 | France | A43B 5/04 |
| 2416661 | 10/1979 | France | 36/121 |
| 2539278 | 7/1984 | France | A43B 5/04 |
| 2569088 | 2/1986 | France | A43B 5/04 |
| 2638337 | 5/1990 | France . | |
| 2676624 | 11/1992 | France | A43B 5/04 |
| 2120242 | 11/1972 | Germany . | |

*Primary Examiner*—Steven N. Meyers
*Assistant Examiner*—Thomas P. Hilliard
*Attorney, Agent, or Firm*—Sandler, Greenblum & Bernstein

[57] ABSTRACT

A sport boot, particularly for performing a gliding sport, produced from an outer sole capable of being fastened at least to one forward part on a gliding member, and including a lower shank connected to a rear heel cap on which a rigid collar is hinged which is designed to surround the lower leg and which extends towards the top of the shank starting from the hinge beyond the upper end thereof, the boot also including an energized arrangement for the angular longitudinal control of the gliding element in the air in respect to the sole of the boot during the phase of advancement of the gliding element, which are disposed between a fixed point of the shank and a movable point of the hinged collar, and which include at least one resilient member constituting an energy source capable of being tensed in the course of a pushing phase on the ski and to relax in the course of the advancement phase, wherein the resilient member which constitutes the energy source is connected with a disengaging arrangement such that it is activated only between a position of the boot of equilibrium which is essentially median, and a position at the end of pushing.

17 Claims, 3 Drawing Sheets

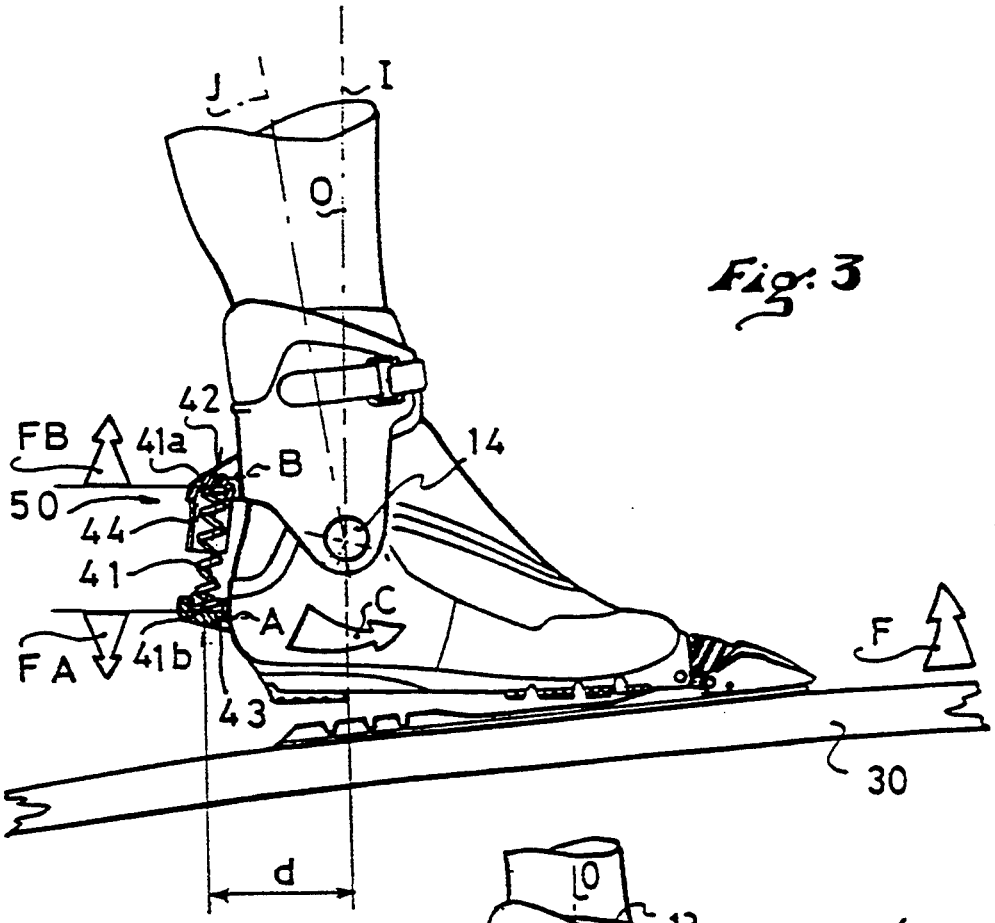
Fig: 3
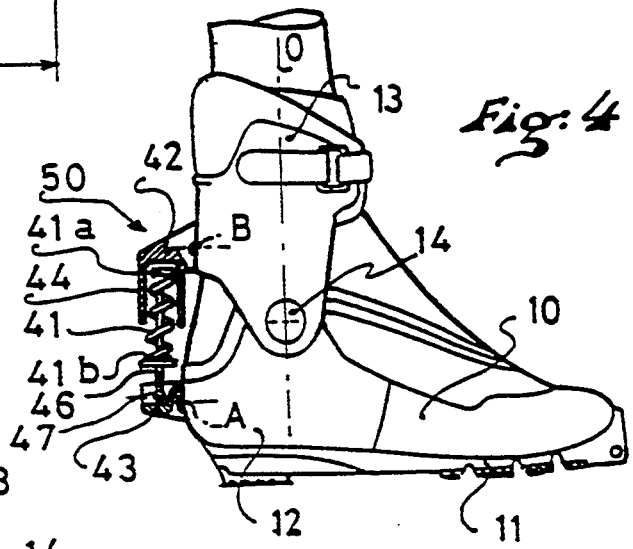
Fig: 4
Fig: 5
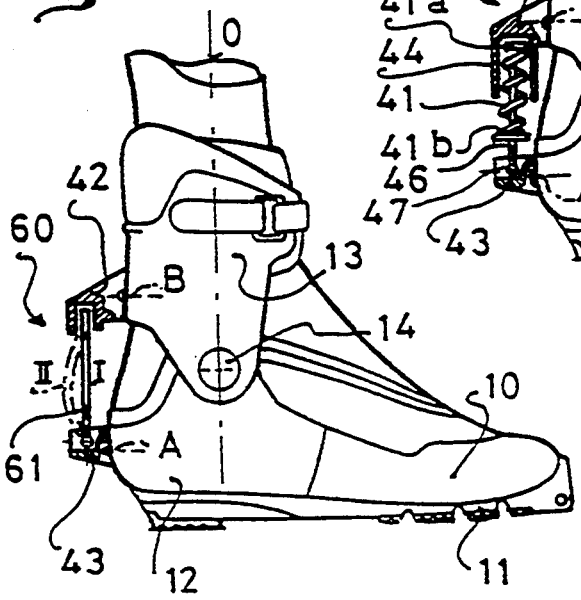

0
13
71c
70
73
71
14
10
71b
71a
72
11

0
13
13 a
83
80
82c
14
82a
82
82b
81
84
12 a 0
13 A
91
10
90
92
93
12

0
13 B
103
100
102
101
10
12

BOOT FOR PERFORMING A GLIDING SPORT WITH AN ELASTIC DEVICE FOR BIASING THE COLLAR

BACKGROUND OF THE INVENTION

1. Field of the Invention

The present invention relates to a sport boot for performing a gliding sport, such as cross-country skiing, namely, performing skating steps (or skating), of a type including an outer sole and a lower shank, provided by a heel cap on which a rigid collar is hinged which is designed to surround the lower leg and which extends towards the top of the shank starting from the hinge beyond the upper end thereof.

2. Discussion of Background and Relevant Information

In the course of performing cross-country skiing, after the skier has ended his or her forward movement on one of the skis, the skier transfers his or her weight to the other, opposite ski, and advances the first ski to the level of the second.

This advancement differs depending on:

—the speed (hence the step used). Actually, the slower the speed, the more the frequency of gliding is increased and therefore the less time the skier has for bringing the ski forward. This is because the slower the speed, the less the skis are advanced parallel, and the more does the skier keep a considerable distance between the two skis.

—the encountered slope. Actually, the skier ought to advance the ski in as parallel a manner as possible for contact with the slope so that he or she does not lift the ski too high. Thus the inclination of the ski while being advanced depends on the encountered slope (which makes advancing it particularly hard and difficult on strong inclines).

These different statements have led to a study of the problem of advancing skis during the performance of skating.

This study has in fact shown that at the time of the disengagement of the ski, its front end or spatula catches on the snow, which causes the very problem residing in the angular longitudinal control of the ski in a quasi-static phase, i.e., in the air. The same problem is posed in other gliding sports, such as ice-skating, in-line skating, where the sportsman must avoid striking the ground with the gliding device (skate . . . ) during the phase of advancing it.

With the problem thus posed, it has also been stated that this results in a consistent consequence for the skier, namely to have to increase the contraction of the anterior tibia for picking up the ski again and to prevent the spatula from catching on the snow during the phase when the ski is advanced. This is all the more unfortunate for the skier because the skier should instead take advantage of this phase for relaxing the muscles of the affected leg to the maximum, because this is the occurrence of a rest and non-moving period.

Applicant had already remedied these disadvantages based on the posed problem, by proposing in French Patent Publication No. 2,676,624 a boot of the previously mentioned type, which is equipped with energizing means for the angular longitudinal control of a ski with the air in respect to the sole of the boot during the phase of advancing the ski.

Such means actually consist in a movement energy between the hinged collar and the shank, advantageously offering an effective assistance for the tibia during this phase of performing skating.

It also results in reduced fatigue for the skier which saves his or her muscles.

Thanks also to these means, the feeling of heaviness of the ski in the area of the spatula is noticeably reduced, and they assure a better anterior-posterior posture as well as a much easier advancement of the ski. Then the start-over takes place under the best conditions because the fatigue is less.

However, the tests have made it also possible to state that although the energizing means have provided a certain assistance in the advancement phase, this has been offset by the generation of fatigue, formerly non-existent, during the pushing phase, more particularly during the forward flexing of the leg in connection with the foot, because actually the collar and the shank are always connected. In fact, during the aforementioned position, it is desirable that the foot should be advantageously free, instead of having to overcome a useless force at that moment, which was precisely provided by the permanent energizing means.

SUMMARY OF THE INVENTION

An object of the present invention is to overcome the aforementioned disadvantage while retaining all previously attained advantages.

To attain this object, the invention relates to a sport boot, namely for performing-a gliding sport (skating), of the type comprising an exterior sole capable to be fastened to a gliding element and a shank provided by a heel cap on which a rigid collar is hinged which is designed to surround the lower leg and which extends towards the top of the shank starting from the hinge beyond the upper end thereof, the boot also including energized means for angular longitudinal control of the gliding element in the air in respect to the sole of the boot during the phase of advancing the gliding element, which are disposed between a fixed point of the shank and a movable point of the hinged collar, and which comprise at least one resilient member constituting an energy source capable of being tensed in the course of a pushing phase on the gliding element and of relaxing in the course of the advancement phase, which is distinguished in that the resilient member which constitutes the energy source is connected with disengaging means such that it is activated only between a median position of equilibrium of the boot, during which the longitudinal axis of the collar is essentially perpendicular with the foot within the horizontal plane of the shaft, and a position at the end of pushing or at the end of the extension of the foot, during which the axis of the collar is maximally inclined towards the back, the means of disengagement rendering the the resilient member inoperative between the position of median equilibrium and a position of maximum forward flexing of the foot in the course of pushing.

The invention will be better understood and other characteristics of the invention will become evident with the aid of the following .-specification, making reference to attached schematic drawings which illustrate in a non-limiting exemplary manner how the invention can be embodied.

BRIEF DESCRIPTION OF THE DRAWINGS

FIGS. 1, 2 and 3 are side elevation views of a cross-country ski boot of the skating type in accordance with the invention, mounted on a ski and respectively in a resting position, an extension position and in an intermediate position during the advancement of the ski.

FIGS. 4 to 9 show in side elevation views different modes of embodying the invention applied to a cross-country ski boot.

DETAILED DESCRIPTION OF THE PREFERRED EMBODIMENTS

Figure 1:
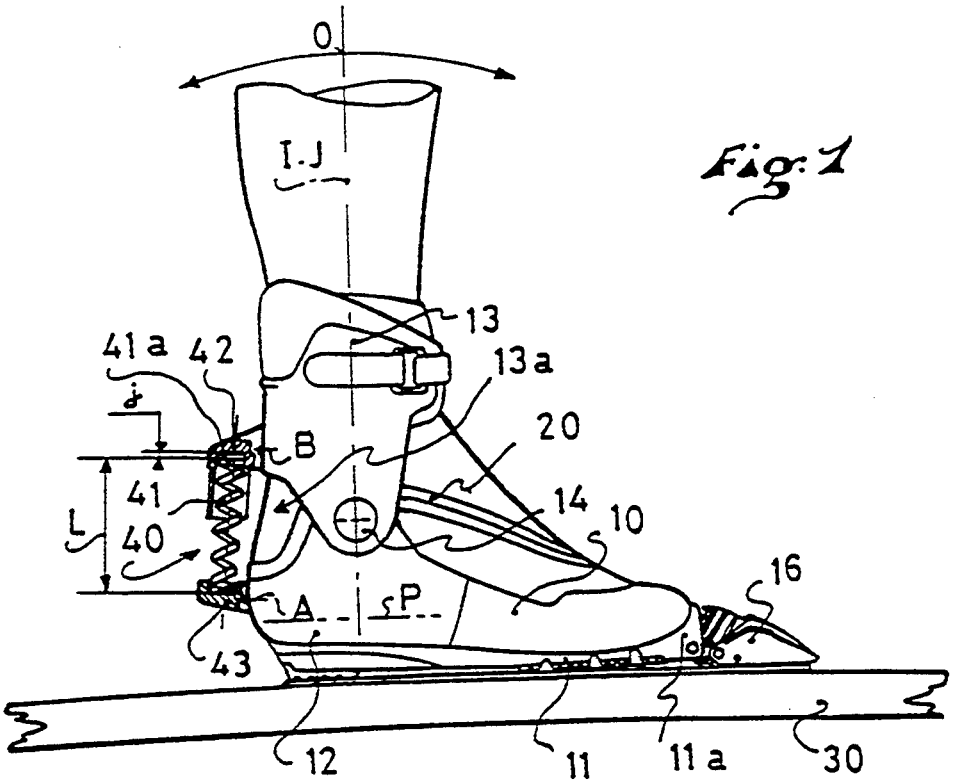

The boot, which is illustrated by means of an example in FIG. 1, is particularly adapted to the step of the skater or to skating and on the exterior presents the look of a boot originally consisting of a lower shank 10, i.e., a shank the height of the rigid parts of which does not extend beyond the ankles, of an outer sole 11 and a fastening and unfastening system 20 for the boot of a known type per se, covering an internal lacing system.

A ski 30 is fastened in the conventional manner to a forward portion 11*a* of the sole 11 by means of a fastening 16, schematically represented.

The shank 10 is of a flexible material and is provided at the level of the heel by a heel cap 12, which can be embodied in a manner known per se.

The heel cap 12 is preferably made of a rigid synthetic material and extends over the entire rear portion of the boot completely around its heel.

The heel cap 12 extends in the area of the ankles up to the height of the shank 10 to receive a hinged collar 13 which is fastened in a manner known per se at the level of the ankles.

The hinged collar 13 is made of a cuff of rigid material and particularly of a synthetic material such as the one known by the commercial name "Pébax".

The collar 13 extends upward as far as below the calf and encloses all of the lower leg. In its front part it is open to let the leg be placed into the boot, and it is also provided with clamping means (not shown) of a type known per se and constituted for example by self-gripping means.

Furthermore, this collar 13 is provided at the back with a scalloping 13*a* which is intended to make the turning of the collar towards the back easier.

In the same way it can be easily conceived that the important height of the collar 13 permits the leg an excellent lateral hold during the performance of skating, such a height also allows a very great redistribution of the reaction efforts over the leg and therefore greater comfort for the user.

In addition, the skating boot in accordance with the invention also comprises energized means 40 for the angular longitudinal control of the shank with respect to the collar, i.e., the ski 30 when it is in the or unweighted with respect to the sole 11 of the boot during the advancement phase of the ski 30, makes it possible to remedy certain disadvantages encountered in the course of performing skating, which have been enumerated hereinabove, In the case of FIGS. 1 to 4, these means 40 are disposed between a point A of the shank A and a point B of the hinged collar 13 and comprise a resilient member 41 constituting an energy source, in this case a metallic spring acting between the points A and B while compressed. Actually, this spring is tensed, i.e., is operative, and in the course of a pushing phase of the ski 30 (see FIG. 2) and relaxes, i.e., is inoperative, in the course of an advancement phase (see FIG. 3), tending to return the shank 10 in the direction of the collar 13 during a pivoting movement toward the back in the direction F, therefore causing the automatic lifting of the front end or spatula of the ski 30 during which it is not in a movement phase.

As shown particularly well in FIGS. 1,to 3, in a resting position (FIG. 1) and with the foot in the boot, the spring 41 is not compressed and has a length L. In this position, the vertical axis I of the boot, which is perpendicular to the horizontal plane P of the shank 10, merges with the axis J of the bottom of the leg from the collar 13 which is congruent with it. Actually, such a resting position corresponds to a median equilibrium position O located between, on the one hand, a position $O_1$ at the end of pushing or the end of extension of the foot, towards which the axis J of the collar 13 is maximally inclined toward the back at an angle $\alpha 1$ and, on the other hand, a position $O_2$ of maximal flexing of the foot toward the front in the course of pushing at an angle $\alpha 2$. Actually, the spring 41 should preferably be in such a position that at rest and with the absence of the foot from the boot, the vertical axis I would be slightly inclined in the direction of the position $O_2$, so that when the foot is placed into the boot, a slight prestressing of the spring at rest is caused, in this way suppressing any play at the start of the pivot movement.

Figure 2:
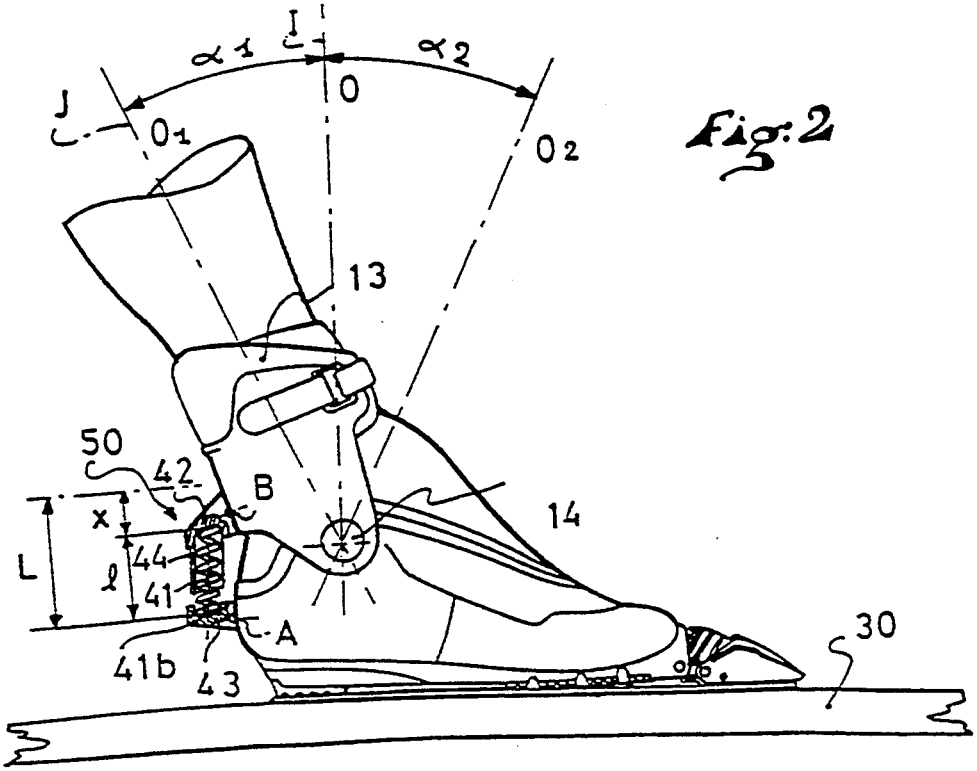

In FIG. 2 it can be clearly seen that, at the time when the extension has ended and the axis J forms an angle $\alpha 1$ with the axis I, the spring 41 is deformed by compression between the points A and B in an amount $x=L-l$ (wherein L equals the length of the relaxed spring and l equals the length of the maximally compressed spring).

Given the fact that in the phase of advancement or return phase of the ski (FIG. 3) the ski is in the air, the result is that it is not placed under any stress, which lets the spring 41 become relaxed. That is, the spring 41 is inoperative to bias the collar 13 forwardly beyond the intermediate equilibrium position O. Thus, two forces FA and FB are generated in opposite directions at the previously mentioned points A and B, respectively, to open the collar of the shank at the back.

The support at B not being deformable because it is connected with the shank, the force FA, multiplied by the lever arm d around the axis 14 causes a moment C which, incidentally, should make the ski rise in accordance with F. Actually, the moment C is cancelled out when e=O, and this is because of disengagement means 50, which render the spring 41 inoperative between the equilibrium position O and the position $O_2$ of maximum forward flexing of the foot during pushing.

According to the exemplary embodiment shown in FIGS. 1 to 4, the disengagement means 50 consist of an upper free end 41*a* of the spring 41 and an also free abutment member 42, disposed on a corresponding part of the collar 13 in accordance with relative positions so as to permit a minimum play "j", so that the cooperation of the parts 41*a* and 42 only occurs in a direction proceeding from the median position O to the position $O_1$ at the end of the extension. In contrast to this, the lower end 41*b* of the same spring 41 is of one piece with or at least has a permanent support on a fixed part 43 of the shank 10.

The fixed part 43 is embodied at the level of the heel cap 12 of the shank 10, and the opposed abutment member 42 is constituted by the bottom of a sheath or housing 44 of one piece with the collar 13, on which, to form the disengagement means 50, the spring 41 is capable of freely gliding between the position O and the position $O_2$ of the collar 13 in contact with the shank 10. In the embodiment of FIG. 4, the spring 41 is mounted along a shank 46 which is hinged at 47 on the fixed part 43 and supports the abutment 41*b* by the lower end of the spring. This shank 46 is then used as a guide.

The embodiment of FIG. 5 essentially differs from the preceding one in that the resilient member consists of a resilient, deformable blade 61, operating by buckling between a resting position I and a working position II, corresponding to the previously mentioned position $O_1$ of the collar 13 in respect to the shank 10, the disengagement means 60 being identical to the previously mentioned one 50.

Figures 6, 7, 8, 9:
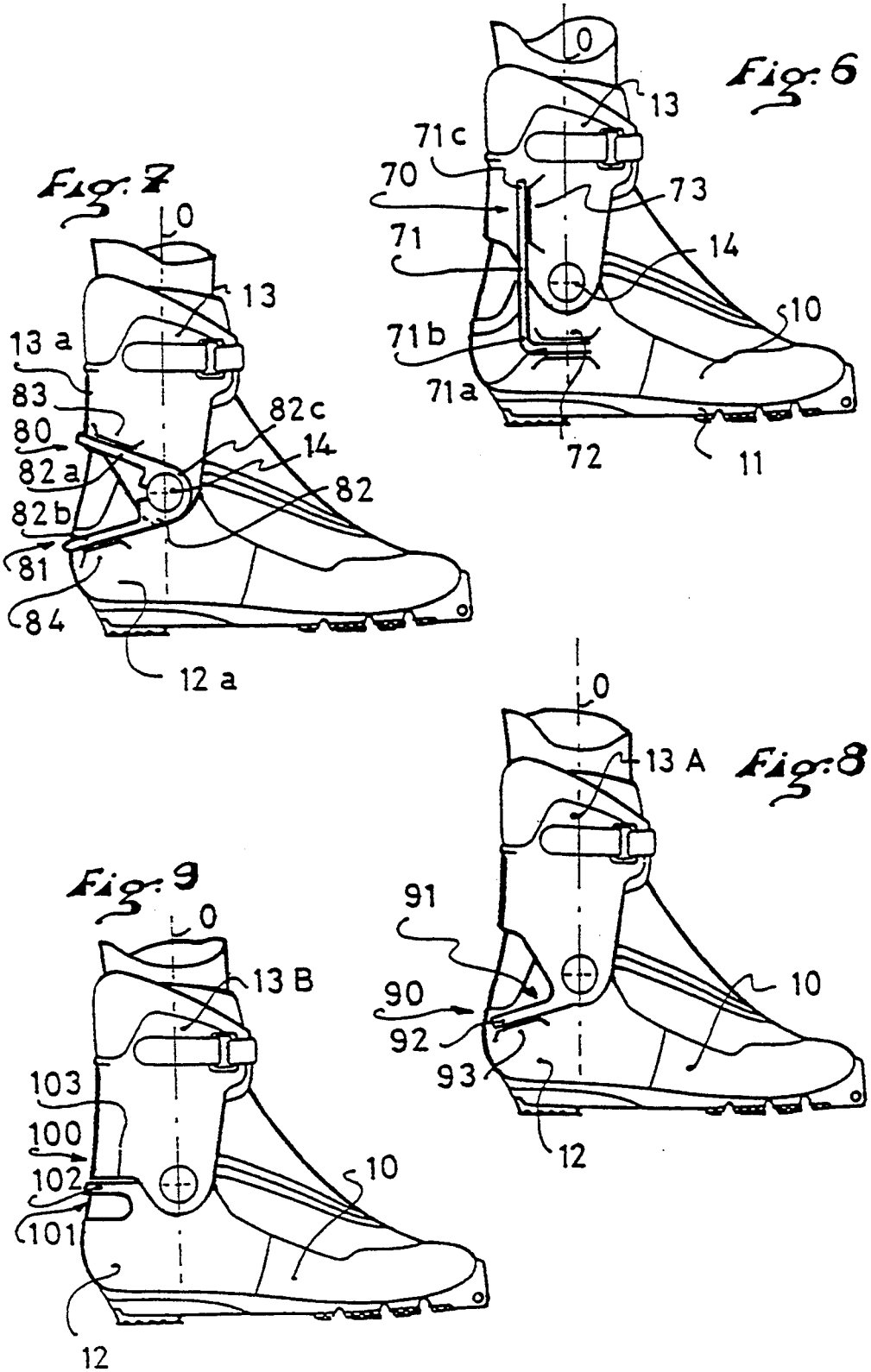

The embodiment of FIG. 6 essentially differs from the preceding ones in that the resilient member 71 consists of at least one resilient, deformable small bar formed by two perpendicular legs, of which the one horizontal one 71*a* is of one piece with a corresponding receptacle 72 embodied on a lateral part of the shank 10, and the other vertical one 71*b* is free and capable of cooperating with its end 71*c* with an abutment member 73 obtained on the side of the collar 13 in the course of an inclination of the latter towards the back beyond the median position O.

The embodiment of FIG. 7 essentially differs from the preceding ones in that the resilient member 81 consists of a deformable pin 82, fixed with its base 82*c* on each one of the hinges or journals 14 of the collar 13 in respect to the shank 10, its upper leg 82*a* and lower leg 82*b*, respectively, being connected with an upper movable abutment 83 of the collar 13 and a lower stationary abutment 84 of the shank 10, which pin 82 is capable of being compressed at the time of an inclination of the collar 13 towards the back beyond the median position O, the upper leg 82*a* being capable of gliding in respect to the abutment 83, to form the disengagement means 80, in a direction of inclination ahead of the collar 13 towards the position $O_2$.

The pin 82 is formed by a double pin comprising upper legs 82*a* disposed on both sides of the collar 13 to enclose it at its rear part 13*a*, while its lower legs 82*b* are disposed on both sides of the shank 10 to also enclose it at its rear part 12*a* at the level of the heel cap 12.

The double pin could either be made in a single-piece manner by molding plastic material or by shaping a metallic filamentary element which can be resiliently deformed, or the like.

The embodiment of FIG. 8 essentially differs from the preceding ones in that the resilient member 91 consists of at least one leg 92 extending from a lower lateral part of the collar 13A, which is capable of coming into contact with a corresponding abutment 93 embodied on a rear part of the shank 10 at the level of the heel cap 12 beyond the median position O of the collar 13A in the backward direction and to move from there in a forward direction to form the disengagement means 90.

The embodiment of FIG. 9,essentially differs from the preceding ones in that the resilient member 101 consists of at least one leg 102 extending from the heel cap 12 of the shank 10 and which is capable of coming into contact with a corresponding abutment 103 embodied on a lower part of the collar 13B beyond the median position O of the collar 13B in the backward direction and to move from there in a forward direction to form the disengagement means 100.

In the two latter cases of the drawing figures, it is advantageous that the legs 92 and 102 be doubled so that they can be disposed on both sides of the boot, with the two parts formed in this way being connected for the purpose of enclosing the back of the shank and in this way to constitute an improved support connection of the collar 13A or 13B on the abutment 92 or on the leg 102.

The instant application is based upon French patent application 92.13566 of Nov. 6, 1992, now Publication No. 2,697,728, the disclosure of which is hereby expressly incorporated by reference thereto, and the priority of which is hereby claimed.

Finally, although the invention has been described with reference of particular means, materials and embodiments, it is to be understood that the invention is not limited to the particulars disclosed and extends to all equivalents within the scope of the claims.

What is claimed is:

1. A sport boot for attachment to a gliding member for performing a gliding sport, said boot comprising:

an outer sole having a forward part, at least said forward part being adapted to be connected to the gliding member;

a lower shank fixed with respect to said outer sole, said lower shank having a heel cap;

a rigid collar extending upwardly from said lower shank and being adapted to extend around a lower leg of a user of the boot;

a hinge connection between said lower shank and said rigid collar for enabling movement of said collar, with respect to said lower shank and with respect to the gliding member, between a maximum forward position and a maximum rearward position and through an intermediate equilibrium position; and an elastic device for biasing said collar in a direction toward said maximum forward position, said elastic device extending between a first part fixed with respect to said lower shank and a second part fixed with respect with said collar for movement of said second part with respect to said first part, wherein said elastic device and one of said first part and said second part comprise a disengagement device, said disengagement device enabling said elastic device to be operative for elastically biasing said collar only between said maximum rearward position and said intermediate equilibrium position, said disengagement device enabling said elastic device to be inoperative for biasing said collar forwardly between said intermediate equilibrium position and said maximum forward position, wherein the boot comprises no means for elastically biasing said collar in a rearward direction from said maximum forward position toward said intermediate equilibrium position.

2. A boot according to claim 1, wherein:

said elastic device comprises a free portion and an attachable portion;

one of said first and second parts comprises a free abutment and the other of said first and second parts comprises a support;

said attachable portion of said elastic device being supported by said support; and said disengagement device comprises said free portion of said elastic device and said free abutment, whereby said free portion of said elastic device and said free abutment are in abutting engagement between said maximum rearward position and said intermediate equilibrium position of said collar and said free portion of said elastic device and said free abutment are disengaged between said intermediate equilibrium position and said maximum forward position of said collar.

3. A boot according to claim 1, wherein:

said first part comprises a support fixed with respect to said lower shank at said heel cap and said second part comprises an abutment end of a housing, said elastic device extending between said support and said abutment end of said housing; and said disengagement device comprises said abutment end of said housing and a free portion of said elastic device, whereby said free portion of said elastic device and said abutment end of said housing are in abutting engagement between said maximum rearward position and said intermediate equilibrium position of said collar and said free portion of said elastic device and said abutment end of said housing are disengaged between said intermediate equilibrium position and said maximum forward position of said collar.

4. A boot according to claim 3, wherein:

said elastic device comprises a metallic compression spring.

5. A boot according to claim 1, wherein:

said elastic device comprises at least one resiliently deformable member having two perpendicular legs including a horizontal leg and a vertical leg;

said first part comprises a receptacle fixed with respect to a lateral portion of said lower shank, said receptacle holding said horizontal leg of said deformable member; and said second part comprises an abutment fixed with respect to a lateral portion of said collar, whereby said vertical leg of said deformable member and said abutment are in abutting engagement between said maximum rearward position and said intermediate equilibrium position of said collar and said vertical leg of said deformable member and said abutment are disengaged between said intermediate equilibrium position and said maximum forward position of said collar.

6. A boot according to claim 1, wherein:

said hinge connection between said lower shank and said rigid collar comprises a journal about which said collar rotates;

said elastic device comprises a resiliently deformable member having a base fixed at said journal and having an upper leg extending from said base and a lower leg extending from said base;

said first part comprises a fixed abutment of said lower shank, said fixed abutment being in abutting engagement with said lower leg of said deformable member; and said second part comprises a movable abutment of said collar, whereby said upper leg of said deformable member and said movable abutment of said collar are in abutting engagement between said maximum rearward position and said intermediate equilibrium position of said collar and said upper leg of said deformable member and said movable abutment are disengaged between said intermediate equilibrium position and said maximum forward position of said collar.

7. A boot according to claim 1, wherein:

said hinge connection between said lower shank and said rigid collar comprises a pair of journals located on opposite lateral sides of said boot along a transverse axis;

said elastic device comprises a resiliently deformable member having a pair of bases fixed at respective ones of said pair of journals and having an upper leg extending from one of said bases, around a rear portion of said collar, to the other of said bases and a lower leg extending from one of said bases, around a rear portion of said lower shank, to the other of said bases;

said first part comprises a fixed abutment of said lower shank, said fixed abutment being in abutting engagement with said lower leg of said deformable member; and said second part comprises a movable abutment of said collar, whereby said upper leg of said deformable member and said movable abutment of said collar are in abutting engagement between said maximum rearward position and said intermediate equilibrium position of said collar and said upper leg of said deformable member and said movable abutment are disengaged between said intermediate equilibrium position and said maximum forward position of said collar.

8. A boot according to claim 7, wherein:

said resiliently deformable member comprises a unitary piece of plastic material.

9. A boot according to claim 7, wherein:

said resiliently deformable member comprises a metallic filamentary element.

10. A boot according to claim 1, wherein:

said second part is a portion of said collar;

said elastic device comprises a resiliently deformable member unitary with and extending from said portion of said collar;

said first part comprises a fixed abutment of said lower shank at said heel cap; and said disengagement device comprising said resiliently deformable member and said first part, whereby said resiliently deformable member and said fixed abutment of said lower shank are in abutting engagement between said maximum rearward position and said intermediate equilibrium position of said collar and said resiliently deformable member and said fixed abutment of said lower shank are disengaged between said intermediate equilibrium position and said maximum forward position of said collar.

11. A boot according to claim 1, wherein:

said first part is a portion of said lower shank;

said elastic device comprises a resiliently deformable member unitary with and extending from said portion of said lower shank;

said second part comprises a fixed abutment of a lower portion of said collar; and said disengagement device comprising said resiliently deformable member and said second part, whereby said resiliently deformable member and said fixed abutment of said collar are in abutting engagement between said maximum rearward position and said intermediate equilibrium position of said collar and said resiliently deformable member and said fixed abutment of said collar are disengaged between said intermediate equilibrium position and said maximum forward position of said collar.

12. A boot according to claim 1, wherein:

said boot comprises no means for elastically biasing said collar forwardly between said intermediate equilibrium position and said maximum forward position.

13. A sport boot for attachment to a gliding member for performing a gliding sport, said boot comprising:

an outer sole having a forward part, at least said forward part being adapted to be connected to the gliding member;

a lower shank fixed with respect to said outer sole, said lower shank having a heel cap;

a rigid collar extending upwardly from said lower shank and being adapted to extend around a lower leg of a user of the boot;

a hinge connection between said lower shank and said rigid collar for enabling movement of said collar, with respect to said lower shank and with respect to the gliding member, between a maximum forward position and a maximum rearward position and through an intermediate equilibrium position; and an elastic device for biasing said collar in a direction toward said maximum forward position, said elastic device extending between a first part fixed with respect to said lower shank and a second part fixed with respect with said collar for movement of said second part with respect to said first part, wherein said elastic device and one of said first part and said second part comprise a disengagement device, said disengagement device enabling said elastic device to be operative for elastically biasing said collar only between said maximum rearward position and said intermediate equilibrium position, said disengagement device enabling said elastic device to be inoperative for biasing said collar forwardly between said intermediate equilibrium position and said maximum forward position;

wherein said first part comprises a support fixed with respect to said lower shank at said heel cap and said second part comprises an abutment end of a housing, said elastic device extending between said support and said abutment end of said housing;

wherein said disengagement device comprises said abutment end of said housing and a free portion of said elastic device, whereby said free portion of said elastic device and said abutment end of said housing are in abutting engagement between said maximum rearward position and said intermediate equilibrium position of said collar and said free portion of said elastic device and said abutment end of said housing are disengaged between said intermediate equilibrium position and said maximum forward position of said collar; and wherein said elastic device comprises a resiliently deformable blade, said biasing of said collar being exerted by buckling of said blade.

14. A cross-country ski boot having a forward portion adapted to be connected to a cross-country ski for practicing cross-country skiing, whereby a skier alternately pushes one of a pair of skis through a pushing phase and advances the other of the pair of skis through an advancing phase, said ski boot comprising:

a sole;

lower shank affixed to and extending upwardly from said sole;

a collar extending upwardly from said lower shank and being adapted to extend around a lower leg of the skier's boot;

a hinge connection between said lower shank and said collar for enabling movement of said collar, with respect to said lower shank and with respect to the ski, between (1) a maximum forward position, at a beginning of said advancing phase and an end of said pushing phase, and (2) a maximum rearward position, at an end of said advancing phase and a beginning of said pushing phase, whereby said collar moves through (3) an intermediate equilibrium position between said maximum forward position and said maximum rearward position;

an elastic device for biasing said collar forwardly from said maximum rearward position to a point limited to said intermediate equilibrium position, said elastic device extending between a portion of said lower shank and a portion of said collar for elastically biased movement of said portion of said collar with respect to said portion of said lower shank; and a disengagement device comprising a portion of said elastic device and an abutment fixed with respect to one of said portions of said collar and lower shank, whereby said portion of said elastic device and said abutment are in abutting engagement only between said maximum rearward position of said collar and said intermediate equilibrium position of said collar, said disengagement device enabling said elastic device to be operative for elastically biasing said collar only between said maximum rearward position and said intermediate equilibrium position, wherein the boot comprises no means for elastically biasing said collar in a rearward direction from said maximum forward position toward said intermediate equilibrium position.

15. A cross-country boot according to claim 14, wherein:

said abutment is fixed with respect to said collar;

said portion of said elastic device is an upper portion in abutting engagement with said abutment between said maximum rearward position of said collar and said intermediate equilibrium position of said collar; and said elastic device comprises a further portion supported by said portion of said lower shank.

16. A cross-country boot according to claim 14, wherein:

said abutment is fixed with respect to said lower shank;

said portion of said elastic device is a lower portion in abutting engagement with said abutment between said maximum rearward position of said collar and said intermediate equilibrium position of said collar; and said elastic device comprises a further portion supported by said portion of said collar.

17. A cross-country boot according to claim 14, wherein:

said boot comprises no means for elastically biasing said collar forwardly between said intermediate equilibrium position and said maximum forward position.

* * * * *